United States Patent [19]

Kumano

[11] Patent Number: 4,476,769

[45] Date of Patent: Oct. 16, 1984

[54] KEYBOARD APPARATUS IN ELECTRONIC MUSICAL INSTRUMENT

[75] Inventor: Shinji Kumano, Hamamatsu, Japan

[73] Assignee: Nippon Gakki Seizo Kabushiki Kaisha, Hamamatsu, Japan

[21] Appl. No.: 446,491

[22] Filed: Dec. 3, 1982

[30] Foreign Application Priority Data

| | | | |
|---|---|---|---|
| Dec. 9, 1981 | [JP] | Japan | 56-196944 |
| Dec. 9, 1981 | [JP] | Japan | 56-196945 |
| Dec. 9, 1981 | [JP] | Japan | 56-182191[U] |
| May 22, 1982 | [JP] | Japan | 57-86885 |

[51] Int. Cl.[3] ..... G10C 3/12

[52] U.S. Cl. ..... 84/434; 84/440

[58] Field of Search ..... 84/423, 433–440

[56] References Cited

U.S. PATENT DOCUMENTS

| | | | |
|---|---|---|---|
| 2,228,141 | 1/1941 | Magnante | 84/440 X |
| 2,565,239 | 8/1951 | Kostka | 84/435 |
| 3,570,359 | 3/1971 | Ohno | 84/423 |

FOREIGN PATENT DOCUMENTS

| | | | |
|---|---|---|---|
| 869583 | 5/1961 | United Kingdom | 84/435 |

*Primary Examiner*—Donald A. Griffin

*Attorney, Agent, or Firm*—Spensley, Horn, Jubas & Lubitz

[57] ABSTRACT

A keyboard apparatus for an electronic musical instrument is arranged that a return spring provided on each key for imparting the key a returning habit from a depressed state is comprised of either a leaf spring, a coil spring or a rod-like spring which is compressed lengthwise to be used in a buckling-deformed state, whereby warping of the spring is minimized, and the spring is allowed to progressively increase its curving after once developing the buckling without the need of increasing the compression load, thereby progressively reducing the reaction force of the spring. Thus, as the key is depressed deeper, there is obtained a lighter sense of key touch, and thereby a key touch resembling that of a piano is obtained.

26 Claims, 40 Drawing Figures

KEYBOARD APPARATUS IN ELECTRONIC MUSICAL INSTRUMENT

BACKGROUND OF THE INVENTION (a) Field of the Invention

The present invention concerns a keyboard apparatus for use in electronic musical instruments such as electronic organs, which is arranged to provide, by a simple structure, a key touch resembling what is obtained in ordinary pianos.

(b) Description of the Prior Art

The keyboard apparatuses which have been provided so far in conventional electronic musical instruments as electronic organs are such that the sense of key touch differs markedly from the sense of key touch in pianos which are natural musical instruments. Therefore, those who have practiced playing the conventional electronic musical instruments have some difficulty in quickly complying themselves to the playing on a piano, and thus these persons have been unable to make a smooth switch-over of key-operation mode to playing a piano. This is because of the following reasons. The keyboard apparatus of a conventional electronic musical instrument is arranged so as to operate keys against the spring force of a tension coil spring, or a compression coil spring, or a U-shaped spring as the case may be which is provided on the keys. Therefore, unlike the action of the keyboard apparatus of a piano which is operative that, during the course of a key depression, the jack is temporarily progressively dislocated from the butt or from the hammer shank, and also that thereafter the reaction force applied to the player's finger suddenly diminishes, the keyboard apparatus of the conventional electronic musical instrument is operative so that, as the key is depressed down progressively, the degree of warping of the spring provided on the key increases, so that the amount of reaction force applied to the finger increases progressively. Such has been the difference noted of the key operations between the piano and the conventional electronic musical instrument. Thus, the latter instrument has the disadvantages that it lacks the touch-response function exerted by the piano keyboard which faithfully transmits the sentiment of the player to the keys, and accordingly the instrument is difficult to play.

Now, consideration is made of the depressing operation of a key 1 which is equipped with a compression coil spring 2 as shown in FIG. 1. The key 1 normally is held in a substantially horizontal position by the compression coil spring 2 as indicated by a vector $P_0$. The balancing in the moments when the key 1 is depressed by the application of a force $F_1$ onto the forward end portion of the key 1 will become as shown by the formula:

$$F_1L=P_0l$$

wherein: L represents the distance from the pivot fulcrum 0 of the key 1 up to the position at which the force $F_1$ is applied; and l represents the arm of moment exerted by the spring 2.

Hence, $$F_1=l/L.P_0 \quad (1).$$

And, the force $F_2$ when the key 1 is depressed fully to the bottom as indicated by the chain line is:

$$F_2=l'/L\cdot P_1 \quad (2).$$

If $l \approx l'$, the spring pressure will become $P_1>P_0$, so that the forces will be: $F_2>F_1$. Thus, one can understand the fact that the sence of key touch increases as the key is depressed progressively to a lower position.

Accordingly, in order to provide a light touch of key operation, and to bring the key operation touch closer to the key operation touch of a piano, there is the necessity for satisfying either one of the following three conditions which are derived from the above-mentioned formulas (1) and (2):

(i) in case $l=l'$, there must be $P_1<P_0$;

(ii) in case $P_0=P_1$, there must be $l'<l$; and (iii) in case both $P_0$ and l vary, there must be the relation $l'P_1<lP_0$.

However, as stated above, in the prior art, either a compression spring, a tension spring or a U-shape spring has been used. Therefore, the key operation has been performed by making use of compression or pulling of the spring as the case may be. Such mode of key operation has a great difficulty in satisfying the condition (i) or (ii) shown above. Hence, there naturally arises the need to design the keyboard apparatus so as to satisfy the condition (iii).

SUMMARY OF THE INVENTION

It is therefore the principal object of the present invention to provide a keybord apparatus of an electronic musical instrument which can provide a key touch sense resembling that of a piano, by making use of a buckling deformation of a return spring provided on each key.

Another object of the present invention is to provide a keyboard apparatus of an electronic musical instrument of the type as described above, which can provide a key touch sense resembling that of a piano, by a simplified arrangement through a combination of a buckling deformation of the return spring and a specific relationship between the anchoring position of the return spring relative to the keyboard frame and the position of the pivot fulcrum of keys on the keyboard.

Still another object of the present invention is to provide a keyboard apparatus of an electronic musical instrument of the type as described above, which can provide the casual coming-off of the return spring and which allows an easy assembling and maintenance operation of the keyboard apparatus.

A further object of the present invention is to provide a keyboard apparatus of an electronic musical instrument of the type as described above, which, owing to the improved configurations of both the keys and the keyboard frame for the purpose of forming the pivot fulcrums of respective keys, allows a cost-down of its manufacture and the availability of good stable key operation without being inconvenienced by the presence of tilting sideways of keys during key operation and scraping of the edges of keys by flashes present at the surfaces of the keyboard frame, during the key operation, which would result in the generation of noises.

BRIEF DESCRIPTION OF THE DRAWINGS

FIGS. 23 and 24 show another embodiment of the keyboard apparatus of the present invention, in which:

FIG. 23 is a diagrammatic sectional view of the keyboard frame showing the state prior to being equipped with a key, and FIG. 24 is a diagrammatic sectional view showing the state after being mounted with a key.

DETAILED DESCRIPTION OF THE PREFERRED EMBODIMENTS

Prior to describing the embodiments of the present invention, explanation will be made firstly of the buckling phenomenon of a leaf spring by referring to FIGS. 2A to 2E.

Figures 2A, 2B, 2C, 2D, 2E:
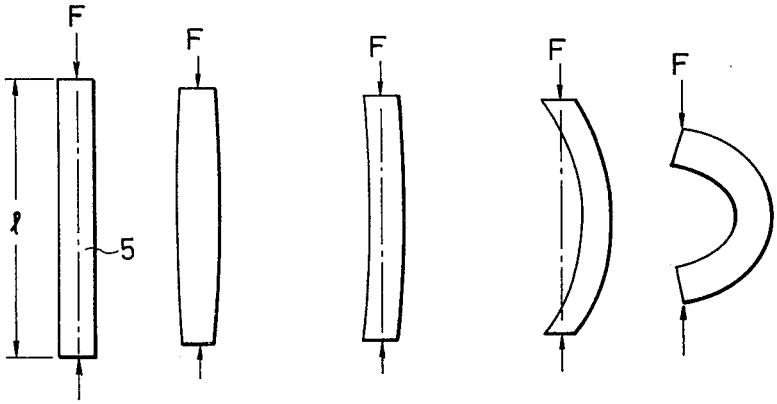
FIGS. 2A to 2E are illustrations for explaining the buckling phenomenon of the leaf spring provided on the keyboard apparatus.

In case a leaf spring 5 is subjected to a compression load in directions crossing at right angle the thickness of the leaf spring as shown in FIG. 2A, the leaf spring 5, ordinarily, would present bulging in the intermediate portion thereof due to compression deformation as shown in FIG. 2B. In case, however, the length l of the leaf spring 5 is substantially greater than the thickness, the leaf spring 5, when the applied load reaches a certain value, will suddenly begin to curve as shown in FIG. 2C due to such factor as a slight displacement of the inner strain of the leaf spring. Ultimately, the spring will easily and suddenly transit to the destructive state as shown in FIG. 2D and FIG. 2E without an increase in the amount of the load applied. Such phenomenon is called, generally, buckling.

Figure 3:
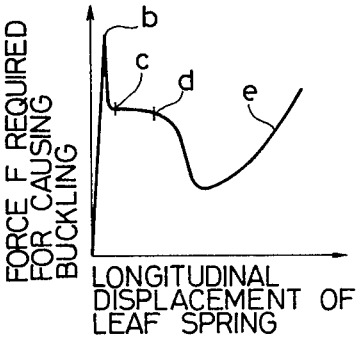
FIGS. 3 and 4 are illustrations showing the relationship between the force required for developing buckling and the longitudinal displacement of the leaf spring.

FIG. 3 shows a reaction force curve in case a leaf spring is subjected to buckling. The respective state shown in FIGS. 2B to 2E correspond to the curves b, c, d and e of FIG. 3, respectively. In these Figures, the state of FIG. 2B represents a very unstable condition, not assuming any fixed value, and depending on cases, there could be an instance of assuming only the value representing the state of FIG. 2C. In such case, the reaction force curve will be as that shown in FIG. 4. And, the value T at such instance is usually called either a critical buckling load or a critical load. In the present invention, arrangement is provided to improve the sense of key touch by utilizing the specific region of rectilinear change beyond the critical buckling load, T, i.e. by making use of the reaction force of the leaf spring in the region between c to d in FIG. 4. It should be understood here that, as the buckling advances up to the state of FIG. 2E, the leaf spring now will bear the nature of a U-shaped spring. Therefore, the reaction force will increase either rectilinearly or curvilinearly (the region of FIG. 3 (e)), and the leaf spring will become no longer suitable for improving the sense of key touch.

Figure 5:
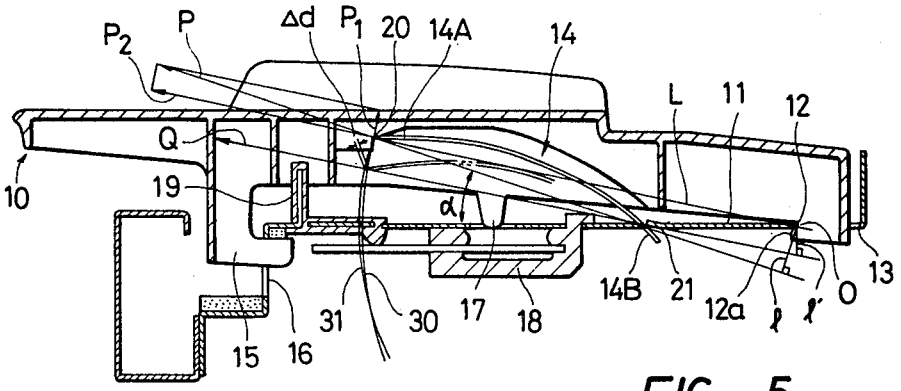
FIG. 5 is a diagrammatic sectional view showing an embodiment of the keyboard apparatus according to the present invention.
Figure 6:
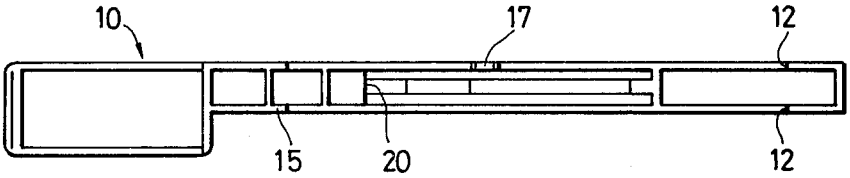
FIG. 6 is a diagrammatic bottom view of a key.

FIG. 5 is a sectional view showing an embodiment of the keyboard apparatus according to the present invention. FIG. 6 is a bottom view of a key. In these Figures, a key 10 which is molded into an integral body with such material as a synthetic resin has an engaging recess 12 formed as the bottom surface in the rear portion thereof. By causing this recess 12 to engage the front edge of an opening 13 which is formed in a keyboard frame 11, the key 10 is allowed to make free vertical pivotal movement about a pivot fulcrum 0. The key 10 which is thus arranged is normally imparted a clockwise returning moment as shown in FIG. 5 by a return spring 14 which will be described later. Also, the key 10 has a stopper 15 of a substantially hook shape, which depends downwardly from the bottom surface of the key 10 at its front portion. The bottom end portion of this stopper 15 freely vertically engages in a hole 16 which is formed in the keyboard frame 11 and normally engages the upper edge of the hole 16 and anchored thereat, thereby holding the key 10 substantially horizontally. And, when the key 10 is depressed against the force of the return spring 14, the key 10 will pivot downwardly in a counterclockwise direction. Along therewith, an actuator 17 actuates aa key switch 18, thereby causing a musical tone corresponding to this key 10 to be generated electrically. It should be noted here that the key 10 descends while being guided by a key guide 19 which is formed integrally on the frame 11. When the depressing force is removed from the key 10, the key will pivot to return to the initial position shown in FIG. 5 by the force of the return spring 14.

Figure 7:
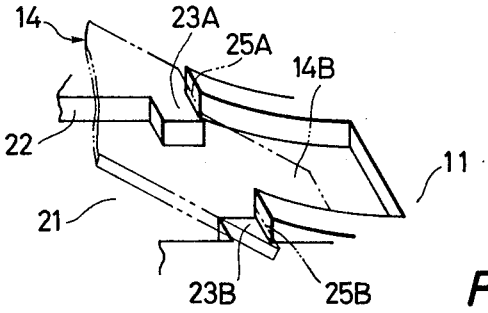
FIG. 7 is a perspective view showing the spring-anchoring portion provided on the keyboard frame.

The return spring 14 is comprised of a leaf spring which, in turn, is formed by, for example, punching a metal plate out. One end 14A of this return spring 14 is pivotably anchored by a spring-anchoring portion 20 which is provided on the upper rear surface of the key 10 at a portion closer to the forward end thereof. The other end 14B of the key 14 is pivotably inserted and anchored likewise in a spring-anchoring portion 21 which is formed on the keyboard frame 11. The spring-anchoring portion 21 of the keyboard frame 11 is positioned between a pivotal fulcrum 0 and the spring-anchoring portion 20 of the key 10, and also pivotably anchors the other end of the return spring 14 in such way as shown in FIG. 7. More particularly, the spring-anchoring portion 21 is comprised of a spring-receiving hole 22 provided in the keyboard frame 11 and a pair of spring-receiving shoulders 23A and 23B which are provided on both sides of said spring-receiving hole 22. This pair of spring-receiving shoulders 23A and 23B serves to pivotably receive cut-out end edges 25A and 25B which are provided on both sides of the other end of the return spring 14, and also serves to prevent a casual slip-off of this spring 14.

The return spring 14 presents a flat plate-like shape in its natural condition prior to being assembled in the keyboard apparatus. When assembled, the return spring 14 is mounted, in a buckled deformation, between the key 10 and the keyboard frame 11. This is materialized because of the arrangement that the distance between the spring-anchoring portion 20 of the key 10 and the spring-anchoring portion 21 of the keyboard frame 11 is set somewhat shorter that the length from the one end 14A of the return spring 14 up to the cut-out end edges 25A, 25B of the frame. Thus, at the time of mounting the return spring 14, it is compressed longitudinally between the spring-anchoring portions 20, 21, so that the return spring 14 is caused to be deformed through buckling into an arcuate shape. By the reaction force P of the return spring 14 which is produced by said deformation, a returning force is imparted to the key 10. In this case, the reaction force P has a component force $P_1$ in the direction connecting the pivot fulcrum 0 and the spring-anchoring portion 20 of the key 10, and another component of force $P_2$ which is in a direction crossing the direction of $P_1$ at right angle. The component force $P_1$ serves as a force to urge the key 10 upwardly, and the rotation moment $P_1 \times L$ at such time will become equal to $P \times l$ (wherein: L represents the distance from the pivot fulcrum 0 up to the spring-anchoring portion 20). On the other hand, the component $P_2$ of force urges the recess 12 of the key 10 to contact the forward edge of the opening 13. Here, the vertical component force of $P_2$ urges the hook portion 12*a* provided at the bottom portion of the recess 12 upwardly to bring it into contact with the rear side of the forward edge of the opening 13.

Figure 4:
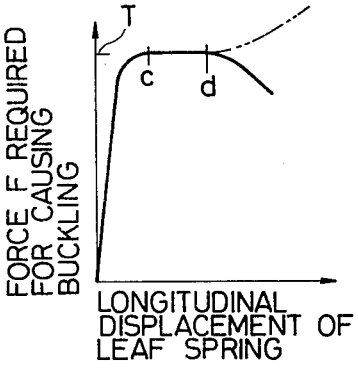

It should be noted here that the return spring 14 is so set that it lies in a relatively flat displacement region which occurs immediately after this spring 14 has begun to buckle, i.e. to lie within the positions c to d of FIG. 4.

Figure 1:
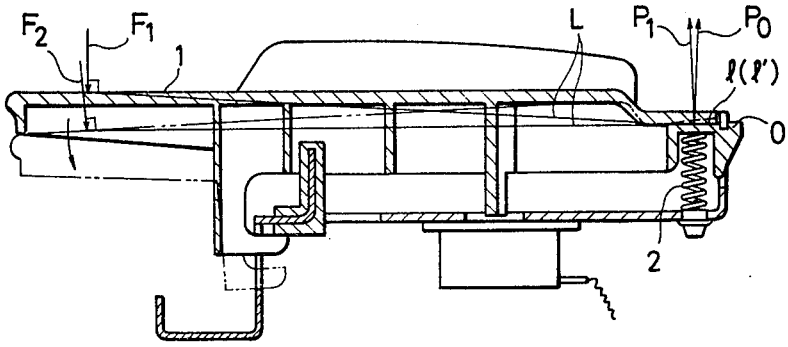
FIG. 1 PRIOR ART
FIG. 1 is a diagrammatic sectional view for explaining the key touch in a conventional keyboard apparatus.

Thus, according to the keyboard apparatus having the foregoing construction, it will be noted that when the forward end portion of the key 10 is depressed downwardly, the force of the return spring 14 will hardly undergo a change or will reduce, so that, as compared with the conventional such apparatus shown in FIG. 1, it becomes possible to provide a light key touch as the key is depressed progressively deeper.

More particularly, when the key 10 is depressed, the spring-anchoring portion 20 of the key 10 will depict loci of an arcuate shape shown at 30 in FIG. 5, about the pivot fulcrum 0 of the key 10. One end 14A of the return spring 14, when not compressed, will depict loci which pass on the inside of the loci depicted by the spring-anchoring portion 20 as shown at 31 in FIG. 5, about the spring-anchoring portion 21 of the keyboard frame 11. Accordingly, when the key 10 has been depressed fully to its lowermost position, the return spring 14 is compressed longitudinally by an amount $\Delta d$. However, in this case the return spring 14 utilizes the specific region between the positions c and d shown in FIG. 4, and accordingly the reaction force Q (see FIG. 5) will hardly increase as compared with P or will reduce only a little even when the spring is compressed for an amount $\Delta d$. Even when the reaction force Q hardly increases, the relationship between $l'$ and $l$ will naturally be $l' < l$, and accordingly the abovementioned condition (2) is satisfied, and thus, as the key is depressed progressively deeper, the sense of key touch can be diminished as shown by the chain line in FIG. 8.

Also, even when the angle $\alpha$ of inclination of the return spring 14 is not small, it is possible to set the relationship of $l'$ and $l$ to $l' < l$. Therefore, if arrangement is made so as to be able to use the spring 14 in the specific region between positions c and d of FIG. 4, $l$ will become greater in accordance with an increase in the amount of the angle $\alpha$, so that P can be taken at a sufficiently small value. Accordingly, it becomes possible to make the return spring mounting operation easy.

Figure 8:
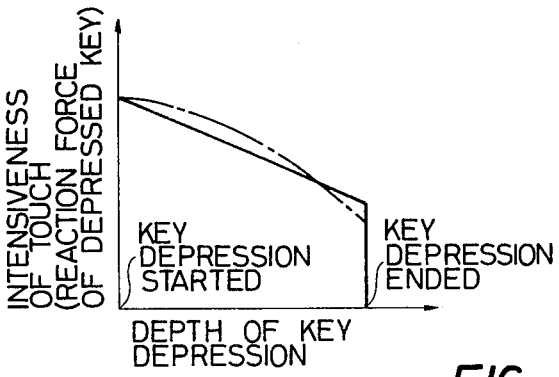
FIG. 8 is a chart showing the relationship between the intensiveness of touch and the depth of depression of a key.

It should be noted here that, in case the angle $\alpha$ of inclination is set at a large value, the key touch will change to depict an arcuate curve (substantially a sine curve) as shown by the chain line in FIG. 8.

Figure 9:
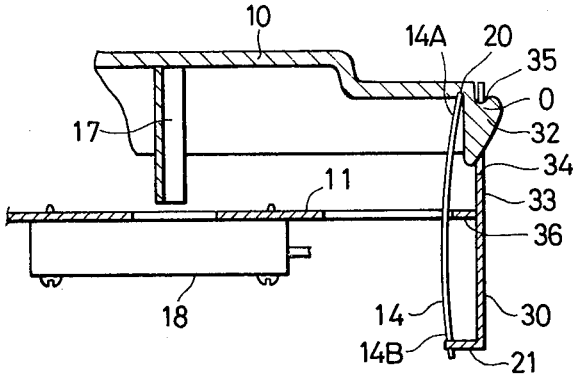
FIGS. 9 and 10 are diagrammatic sectional views of an essential part of the keyboard apparatus, showing other embodiments, respectively, of the present invention.

FIG. 9 is a sectional view of an essential part, showing another embodiment of the present invention. This embodiment is of the arrangement that the return spring 14 is disposed almost vertically, and that one end 14A of this spring 14 is pivotably anchored at the concave spring-anchoring portion 20 provided at the bottom surface in the rear end portion of the key 10, and that the other end 14B is likewise pivotably anchored by the spring-anchoring portion 21 which is provided at the bottom end of the bent portion 30 depending downwardly from the rear end portion of the keyboard frame 11 integrally therewith. In this instance, the distance between the spring-anchoring portion 20 of the key 10 and the spring-anchoring portion 21 of the keyboard frame 11 is set to be somewhat shorter than the length of the return spring 14, and as a result the return spring 14 is compressed lengthwise and presents a buckling deformation as in the case of the embodiment shown in FIG. 5. The key 10 has a projection 32 which protrduces from the rear end surface of the key, and this projection 32 is inserted in a hole 34 of a key-supporting portion 33 which is provided at the rear end portion of the keyboard frame 11 so as to extend upwardly. As a result, an engaging recess 35 which is formed at the upper face of the based portion of the projection 32 engages the upper edge of said hole 34 to provide a pivot fulcrum 0 for the key 10. This pivot fulcrum 0 serves in such way that, by its approach toward the spring-anchoring portion 20 of the key 10, the amount of descension of the spring-anchoring portion 20 during the depression of the key is decreased. Also, a projection strip 36 which is provided on the key-supporting portion 33 is intended for imparting a buckling to the return spring 14.

In such arrangement also as stated just above, it will be understood clearly that the return spring 14 is made to be subjected to a buckling preliminarily, and therefore, as the key 10 is depressed deeper, the key touch becomes lighter, and that there can be obtained an effect similar to that obtained in the preceding embodiment.

In short, although $l \approx l'$, the relationship between $P_1$ and $P_0$ is $P_1 \leqq P_0$, so that the condition (1) can be satisfied.

Figure 10:
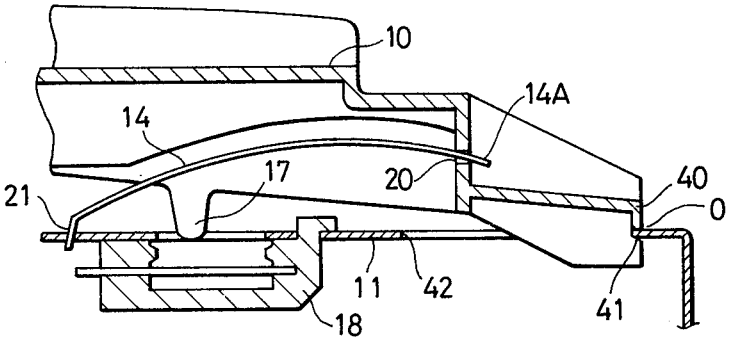

FIG. 10 is a sectional view of an essential part, showing another embodiment of the present invention. This embodiment is of the arrangement that the return spring 14 is disposed in a direction opposite to that of the embodiment shown in FIG. 5, and that one end 14A of this spring is anchored by a spring-anchoring portion 20 which is comprised of a through-hole formed in the rear end surface of the key 10, and that the other end 14B is anchored by a spring-anchoring portion 21 which is provided on the keyboard frame 11 at a position ahead of said spring-anchoring portion 20. At the time of assembling the return spring 14, it is compressed longitudinally, so that it is made to undergo a buckling deformation in an arcuate form in much the same way as that in the embodiment of FIG. 9. At the rear end of the key 10 is provided an extension 40 which protrudes rearwardly therefrom integrally therewith. A recess 41 which is provided in this extension 40 engages the rear edge of an opening 42 formed through the keyboard frame 11 to provide a pivot fulcrum 0 of the key 10.

In this instance, the return spring 14 faces in the reverse direction. Accordingly, when the key 10 is depressed, the return spring 14 will be compressed in an amount greater than the compression amount $\Delta d$ in the embodiment of FIG. 5 owing to the positional relationship between the spring-anchoring portions 20 and 21. However, the reaction force of the spring 14 per se tends to remain without change or to reduce somewhat even when the spring 14 warps in a substantially large amount. Also, the reaction force of this return spring 14 hardly undergoes a change in the specific region between said positions c and d of FIG. 4. Accordingly, an effect similar to that obtained in the embodiments of FIGS. 5 and 9 can also be obtained in the instant embodiment.

Figure 11A:
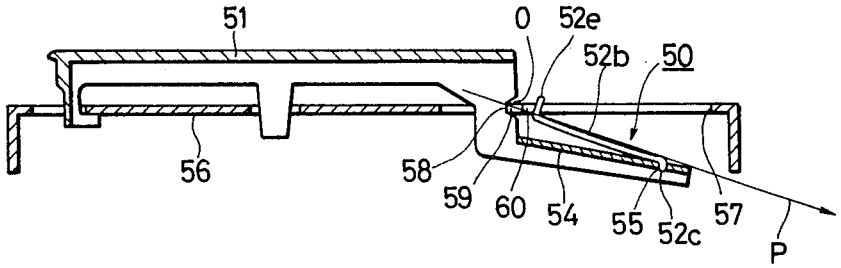
FIGS. 11A to 11C are a diagrammatic sectional view, a plan view of an essential part, and a perspective view, of the return spring of another embodiment of the present invention, respectively.
Figure 11C:
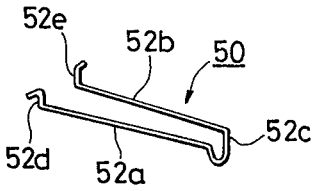
Figure 11B:
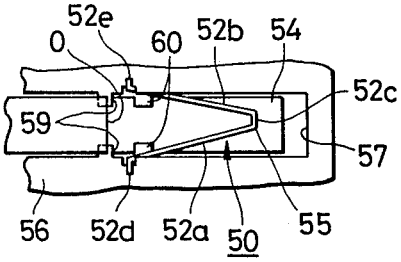

FIGS. 11A, 11B and 11C are a sectional view, a plan view of an essential part of another embodiment, and a perspective view of a return spring for use in this embodiment, respectively. In this embodiment, a return spring 50 is disposed rearwardly of a key 51. The spring 50 is made with a wire which is bent into a substantially V-shape, and the bent portion of the V-shape is further bent in a direction crossing the axes of these arms substantially at right angle. As a result, the spring has a pair of right and left rectilinear portions 52*a*, 52*b*, and a connecting portion 52*c* which connects one ends of these rectilinear arms together. Also, the other ends of the rectilinear portions 52*a* and 52*b* are provided with hook-shaped anchoring portions 52*d* and 52*e* which are bent in directions opposite to the directions of the connecting portion 52*c*. On the other hand, at the lower portion of the rear end portion of the key 51 is provided an extension 54 which extends, integrally, rearwardly at a lower portion of the key 51. At the forward end portion of this extension 54 is formed a hole 55 which is a spring-anchoring portion for anchoring the connecting portion 52*c* of the return spring 50.

A pair of supporting strips 59, 59 which jointly constitute a pivot fulcrum 0 by their engagement with a recess 58 of the key 51 protrude on both sides of a forward end portion of an opening 57 through which the rear end portion and the connecting portion 52*c* of the key 51 are inserted. At sites slightly rearward of the pair of supporting strips 59, 59, there are formed recesses 60, 60 to serve as the spring-anchoring portions, respectively, for anchoring the respective anchoring portions 52*d*, 52*e* of the return spring 50. The distance between each of the recesses 60, 60 and said hole 55 is set slightly shorter than the length of each of the rectilinear portions 52*a*, 52*b* of the return spring 50. As a result, when the return spring 50 is assembled by anchoring the connecting portion 52*c* in the hole 55 and by causing the pair of anchoring portions 52*d*, 52*e* to engage in the respective recesses 60, 60, the pair of rectilinear portions 52*a* and 52*b* will undergo a buckling deformation as they are compressed lengthwise, and the reaction force P due to this buckling is applied to the key 51. It is needless to say that, in this case, the specific region from c to d immediately after buckling which is shown in FIG. 4 is utilized.

It will be clear that, in such construction also as described above of this embodiment, there is little augmentation of the reaction force of the return spring 50 following the key depression, and that accordingly there can be obtained an effect similar to that obtained from the preceding embodiment.

Description has been made of the embodiments of FIGS. 5, 9 and 10 wherein the return spring 14 is invariably constructed with a leaf spring. It should be understood, of course, that the shape of the return spring is not limited thereto, but there can be employed a rod-like spring having an appropriate outer diameter, and that its buckling can be utilized. Furthermore, there may be used also a compression coil spring having a relatively small diameter.

However, by the employment of either a leaf spring or a rod-like spring, any additional processing as may be required of other types of spring can be dispensed with, and thus these two types of springs are superior in their manufacturability. More specifically, the leaf spring or the rod-like spring does not require a bending step which is necessary in case of manufacturing a U-shape spring, or does not require a winding step such as needed for a coil spring, and thus the number of the processing steps can be simply reduced. Thus, these leaf spring and rod-like spring contribute to a cost reduction, and moreover they present little variance due to manufacturing errors. Therefore, these springs have a large advantage that there can be obtained a keybrord apparatus which provides for uniform key touches and which has a stable function.

Also, by utilizing the specific region between positions c and d shown in FIG. 4 wherein there hardly arises a change in the load in attaching a return spring to the apparatus, it should be noted that, even when the accuracy of its attachment position, i.e. the precision of the distance between the spring-anchoring portions 20 and 21 (see FIG. 5), is not good, yet there can be obtained a uniform key touch. In other words, this means that the precision of manufacture of the product apparatus may be rough to some degree, and this, in turn, results in a reduction of the manufacturing cost.

Figures 12A, 12B, 12C, 12D:
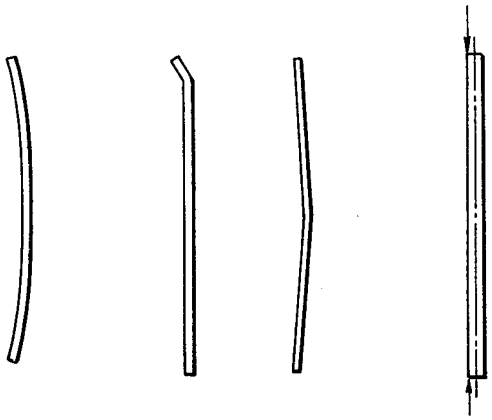
FIGS. 12A to 12D are diagrammatic side elevations showing other embodiments, respectively, of the leaf spring for use in the keyboard apparatus of the present invention.

Also, as the leaf spring, it is not limited to only a flat strip-like spring when it is at non-loaded state. The leaf spring which has a slightly curved shape as shown in FIG. 12A, and a spring having a small bent portion as shown in FIGS. 12B and 12C, and one applied with a deviated load as shown in FIG. 12D may also be used. The leaf spring further includes those having been preliminarily made in such manner that will easily cause a buckling.

Figure 13:
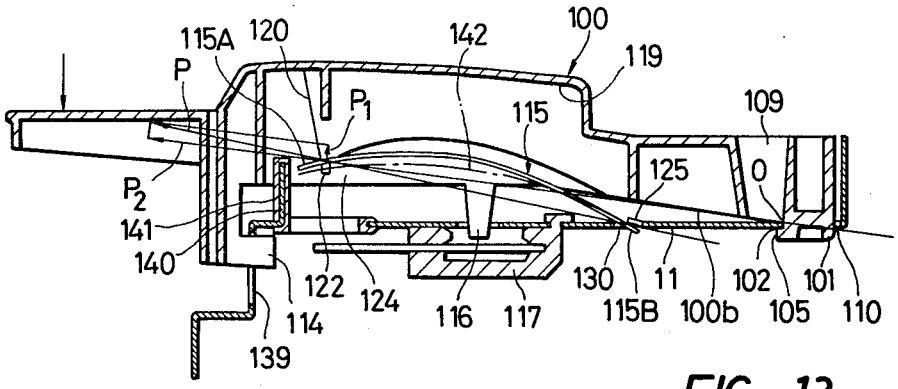
FIG. 13 is a diagrammatic sectional view of another embodiment of the keyboard apparatus according to the present invention.
Figure 14:
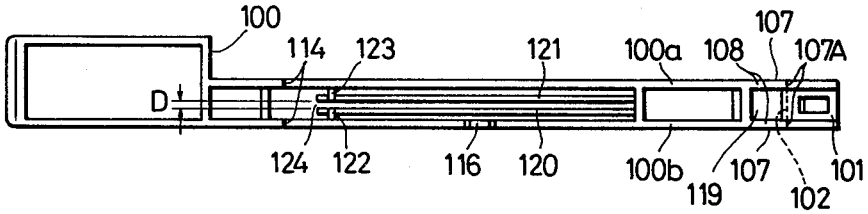
FIG. 14 is a diagrammatic bottom view of a key of the keyboard apparatus shown in FIG. 13.

FIG. 13 is a sectional view of another embodiment of the keyboard apparatus according to the present invention. FIG. 14 is a bottom view of a key. In these Figures, numeral 100 represents a key which is molded as an integral body with a synthetic resin. By molding the key 100 in such condition as would hollow out the under side, the resulting key 100 presents a substantially U-shape section. At the rear end under surface of the key 100, there is provided a projection 101 extending downwardly beyond the lateral side walls 100*a* and 100*b* of the key 100. Also, in the foreground of this projection 101, there is provided an engaging recess 102 for constituting a pivot fulcrum 0 of the key 100.

Figure 15:
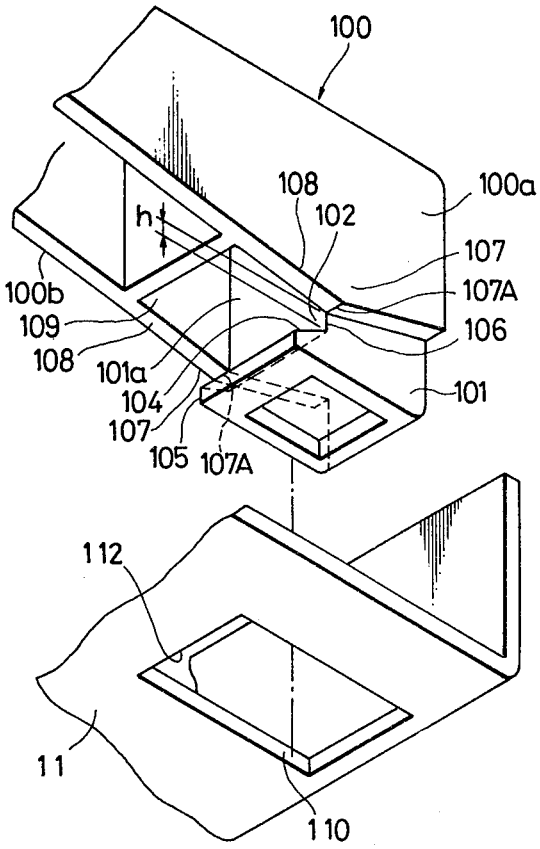
FIGS. 15 and 16 are diagrammatic perspective view and a rear view, respectively, of an essential part of the key shown in FIG. 13.
Figure 17:
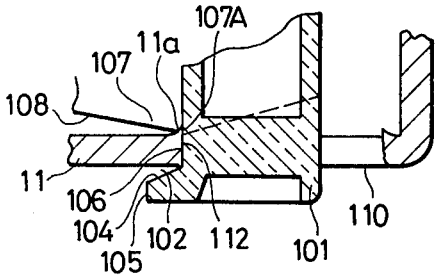
FIG. 17 is an illustration for explaining the effect of this instant embodiment.

The detailed arrangement of the projection 101 and the engaging recess 102 will be explained by referring to FIGS. 15 and 17. The projection 101 is provided so as to protrude in a substantially square tubular form along the inside surfaces of the lateral walls 100*a* and 100*b*, thus having a width identical with the distance between the inside surfaces of these walls. The engaging recess 102 is formed throughout the entire breadthwise length of the projection 101, and has one side wall 104 and a vertical lower end surface 106 constituting the same plane with the forward surface 101*a* of the projection 101. The side wall portion 104 is constituted by the upper surface of a protruding strip 105 which protrudes in the forward direction from the forward bottom end portion of the projection 101. This side wall portion is inclined downwardly toward the left side as shown in FIG. 15. The height h of the lower end surface 106 is set substantially equal to the thickness t of the wall of the keyboard frame 11 (h=t). In this embodiment, the height h is established by a cornered receiving portions 107, 107 having a substantially V-shape which are provided on the lateral side walls 100*a* and 100*b* of the key 100, and by said side wall portion 104. The V-shape receiving portion 107 is formed in such way that its ridge line 107A is in agreement with the bottom surface 106 of the engaging recess 102. An inclined surface 108 which extends in the foreground of the ridge line 107A substantially constitutes the side wall portion which extends above said engaging recess 102. It should be noted here that, at the rear end portion of the key 100, there is formed a through-hole 109 through which the mold or die is withdrawn out at the time of manufacture and which opens through both the top and bottom surfaces of the key 100, and this die-withdrawing hole 109 enables the formation of said engaging recess 102. Accordingly, the engaging recess 102 can be formed easily by a pair of upper and lower molds or dies, without the use of a slide core.

Through the rear end surface of the keyboard frame 11 is formed, by punching, a rectangular insertion aperture 110 in correspondence to the projection 101. This insertion aperture 110 serves to vertically pivotably support the key 100. More particularly, the mounting of the key 100 onto the keyboard frame 11 is effected by first inserting the projection 101 through the insertion aperture 110 from above and then moving it forwardly until the bottom surface 106 of the engaging recess 102 of the key 100 is brought into close contact with the forward end edge 112 of the insertion aperture 110. Whereupon, the key 100 is pivotably arranged about the engaging recess 102 to serve as the pivot fulcrum 0. By the fact that the side wall portion 104, i.e. the protruding strip 105, is positioned on the rear surface side of the peripheral edge portion of the insertion aperture 110, an upward slip-off of the key can be avoided. And, concurrently, the respective ridge line portions 107A and 107B of the V-shaped receiving portion 107 abut the surface of the peripheral edge portion of the insertion aperture 110. This and said protruding strip 105, jointly, prevent a vertical play of the key 100. A lateral play of the key 100 can be restricted or prevented by forming the width of the insertion aperture 110 substantially identical with or somewhat greater than the projection 101.

Now returning back to FIGS. 13 and 14, the construction of the key 100 will be explained. This key 100 further has a stopper 114 of a substantially hook shape which depends downwardly from the bottom surface of the forward end of the two lateral side walls 100*a* and 100*b*. The lower end portion of this stopper 114 is engagingly inserted, for vertical displacement, in a through-hole 139 which is formed through the forward surface portion of the keyboard frame 11. Accordingly, the key 100 is allowed to make a vertical pivotal movement for a small angle within the range of the dimension of the height of the through-hole 139, and is normally imparted a clockwise return habit of FIG. 13 by the force of a return spring 115 which will be described later. And, when the forward end portion of the key is depressed against the force of the return spring 115, the key 100 descends in its pivotal movement couterclockwise about the engaging recess 102 serving as its pivot fulcrum 0. Along therewith, an actuator 116 which depends downwardly from the lateral side wall 100*b* actuates a key switch 117 which is fixed to the keyboard frame 11. Whereby, a music tone corresponding to the key 100 is electrically generated.

A pair of lengthy spring-receiving walls 120, 121 depends in the lengthwise direction from the central portion of the inner bottom surface of the key 100. Their bottom ends are arcuately curved as shown. Also, projections 122 and 123 depend downwardly from the bottom ends of the forward ends of the pair of spring-receiving walls 120 and 121, respectively. The pair of projections 122, 123 and the bottom ends of the forward ends of said spring-receiving walls 120, 121 jointly constitute a spring-anchoring portion 124 of the key 100.

Figure 18:
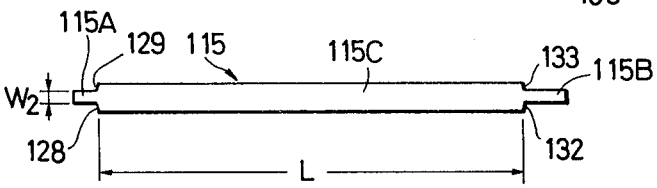
FIG. 18 is a plan view of the return spring in its extended state.

The return spring 115 is comprises of a leaf spring having such configuration as shown in FIG. 18 by punching through a metal plate of an appropriate thickness. An end 115A of this return spring 115 is pivotably anchored by a spring-anchoring portion 124 of the key 100, and the other end 115B is pivotably anchored as it is being inserted in a spring-anchoring portion 125 which is provided on the keyboard frame 11 and which will be described later. The width $W_2$ of both the one end 115A and the other end 115B of the return spring 115 is set smaller than the width of the main body 115C of the return spring 115 and somewhat smaller than the distance D between the pair of projections 122 and 123. And, the one end 115A of the return spring 115 is pivotably anchored in the spring-anchoring portion 124 in such form that it is inserted therein from behind thereof. At such instance, shoulders 128 and 129 which are provided at the boundaries between the main body 115C and one end 115A are brought into contact with the rear faces of the pair of projections 122 and 123, respectively.

Figure 19:
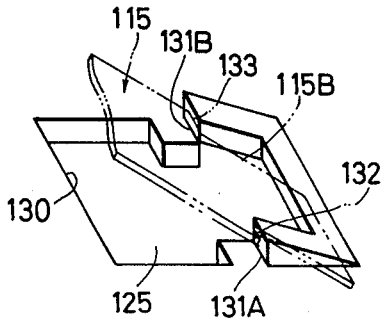
FIG. 19 is a diagrammatic perspective view showing the spring anchoring portion of the keyboard frame in FIG. 18.

The spring-anchoring portion 125 of the keyboard frame 11 is positioned between the pivot fulcrum 0 of the key 100 and the spring-anchoring portion 124 of the key 100, and pivotably anchors the other end 115B of the return spring 115 in a manner as shown in FIG. 19. More specifically, this spring-anchoring portion 124 is comprised of a substantially T-shaped spring-receiving hole 130 which is provided on the keyboard frame 11, and a pair of left and right spring-receiving shoulders 131A and 131B which are provided by upwardly bending, as shown, a portion of each of both lateral edges at the narrow width sides of the spring hole 130. By these paired spring-receiving shoulders 131A amd 131B, the shoulder portions 132 and 133 which are provided at the boundaries between the other end 115B of the return spring 115 and the main body 115C of the spring 115 are pivotably supported, and also they prevent the downward escaping of this spring 115.

The return spring 115 preserves its flat plate shape in its natural state prior to being assembled, and it is mounted in a buckle-deformed state between the key 100 and the keyboard frame 11. This is effected because of the arrangement that the distance between the spring-anchoring portion 134 of the key 100 and the spring-anchoring portion 125 is set somewhat shorter than the length L of the main body 115C of the return spring 115. At the time that the key 100 is mounted, it is longitudinally compressed by the spring-anchoring portion 124, whereby the return spring 115 undergoes an arcuate buckling deformation as shown in FIG. 13. By the reaction force P of the spring 115 which is developed by this deformation, the key 100 is imparted a returning force. In this case, the reaction force P has a component of force $P_1$ in the direction obtained by connecting together the pivot fulcrum 0 and the spring-anchoring portion 124 of the key 100, and a component of force $P_2$ in a direction perpendicular to said direction of $P_1$. The component of force $P_1$ serves as the force to urge the key 100 upwardly, and the rotation moment $P_1 \times L$ (wherein: L represents the distance from the pivot fulcrum 0 to the spring-anchoring portion 124) at such time will become equal to $P \times l$. On the other hand, the other component of force $P_2$ urges the engaging recess 102 of the key 100 against the forward edge of the insertion aperture 110. However, the vertical component of force of $P_2$ urges upwardly the projection 105 which is provided at the lower portion of the engaging recess 102 to bring it into a pressure contact with the rear side of the forward edge of the insertion hole 110.

Figure 20:
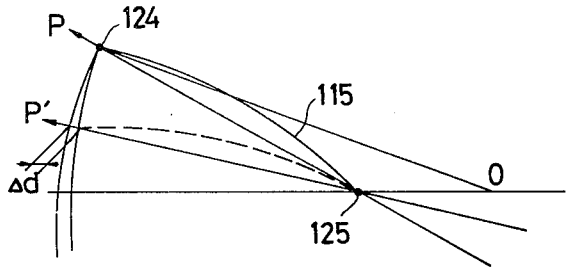
FIG. 20 is a chart for explaining the action of the return spring shown in FIG. 19.

In this case, by assembling the return spring 115 in its state of immediately after being buckled, the key touch will become lighter relative to the instance wherein, for example, a conventional compression coil spring or a tension coil spring is used, and thus it is possible to obtain a touch sense resembling that of an ordinary piano. More specifically, as the leaf spring is compressed continuously in its longitudinal direction until a certain load amount is reached, the leaf spring will suddenly develop a buckling and begins to curve. The load when the leaf spring develops this buckling is called a critical buckling load. After the buckling is started, the curving of the leaf spring will increase gradually without increasing the load, and the reaction force of the leaf spring will exhibit the tendency to decrease. Accordingly, even when the leaf spring is warped longitudinally by an amount $\Delta d$ due to the displacement between the pivot fulcrum 0 of the key 100 and the pivot fulcrum (spring-anchoring portion 125) of the return spring 115 as shown in FIG. 20 when the key 100 is depressed fully, this amount $\Delta d$ remains to be very small, and accordingly the reaction force P' does not increase markedly in proportion to the amount of displacement unlike the compression coil spring and the tension coil spring, and also owing to the descension of the spring-anchoring portion 124, the component force P' will become closer to horizontal position than P, making the key-uplifting moment further smaller. As a result, the key touch becomes lighter as the key 100 is depressed downwardly progressively.

The keyboard frame 11 further is provided with a spring-anchoring strip 140. This spring-anchoring strip 140 is intended to provisionally anchor the one end 115A of the return spring 115 prior to the installment of the key 100. For example, by cutting and erecting a portion of the keyboard frame 11, the strip 140 will extend upwardly integrally with the keyboard frame 11, and is covered with a cover member 141 which is made of, for example, rubber, or a soft synthetic resin. Also, the spring-anchoring strip 140 is positioned slightly in the foreground of the return spring 115 to keep the one end 115A of the spring 115 from contacting the cover member 141 during the depression of the key. And, the spring-anchoring strip 140 will serve as a key guide to restrict and prevent the sideways pivotal movement of the key 100, as the spring-anchoring strip 140 is inserted from the opening provided at the bottom surface of the key 100. In case the cover member 141 is not used, and in case the one end 115A of the return spring 115 is provisionally anchored directly by the spring-anchoring strip 140, it is only necessary to provide a recess so as to be able to effect the anchoring at a certain position.

The return spring 115 is inserted into the spring-receiving hole 130 from the lower portion of the keyboard frame 11 before mounting the key 100, so that one end 115A thereof is brought into contact with the rear side of the cover member 141 in such manner as shown by one-dot-chain line 142 in FIG. 13, while the other end 115B is anchored by the spring-anchoring portion 125 of the keyboard frame 11, whereby the return spring 115 is provisionally fixed, in its buckling-deformed state, onto the keyboard frame 11. Next, in the forwardly downwardly inclined state of the key 100, its stopper 114 is inserted into the through-hole 139, and the rear end portion of the key 100 is pressed downwardly. During this movement, the pair of projections 122 and 123 descend onto both sides of the one end 115A of the return spring 115 so that the projections 122 and 123 will urge, at their rear sides, the shouldered portions 148 and 149 (see FIG. 18). As a result, the return spring 115 is compressed further and deformed from the state shown by one-dot-chain line 142 in FIG. 14, and one end 115A thereof is detached from the cover member 141 and is anchored by the spring-anchoring portion 124 of the key 100. And, as the rear end portion of the key 100 is further depressed downwardly, the projection 101 is caused to be inserted into the insertion aperture 110, and the key 100 is slightly moved forwardly by the reaction of the return spring 115, and its engaging recess 102 engages the forward edge of the insertion aperture 110. With this, the key-mounting operation completes.

In the keyboard apparatus having the foregoing arrangement, the key 100 is mounted, by first inserting, in a manner similar to the conventional manner, its stopper 114 into the through-hole 139, from above the return spring 115 which is preliminarily provisionally fixed on the keyboard frame 11, and next the engaging recess 102 is caused to engage in the insertion aperture 110, and only thus the key 100 is mounted on the keyboard frame 11. Whereupon, the spring-anchoring portion 124 receives the one end 115A of the return spring 115 from the spring-anchoring strip 140 and anchors same, so that the return spring 115 and the key 100 can be assembled easily, and yet the return spring 114 will not come off from the key. Also, at the time of maintenance service, the key 100 is rearwardly pressed against the force of the return spring 115, and the engaging recess 102 is detached from the forward edge of the insertion aperture 110, and the rear end portion of the key 100 is upwardly pivoted about the stopper 114 as the pivot fulcrum 0. Whereupon, the spring-anchoring portion 124 of the key 100 also ascends upwardly and is detached from the one end 115A of the return spring 115 and releases this spring 115. Accordingly, the one end 115A of the spring 115 is brought into engagement with the rear side of the spring-anchoring strip 140 and is anchored thereat. As such, even when the key 100 is removed from the keyboard frame 11, the return spring 115 is anchored by the spring-anchoring portion 125 and the spring-anchoring strip 140, and will not come off. Furthermore, the amount of warping of the return spring 115 due to compression is determined by the distance between the spring-anchoring portions 124 and 125, and accordingly, the return spring will not be bent more than necessary at the time of assembling and removal unlike the conventional compression coil spring or pulling coil spring, and thus the return spring 115 will undergo little change in the reaction force.

Figure 21:
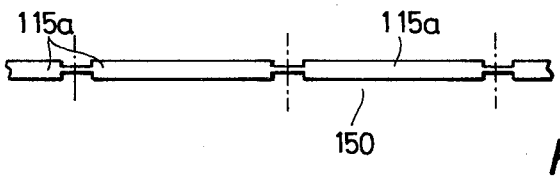
FIG. 21 is a plan view of an essential part of the spring means for use in the keyboard apparatus of FIG. 3.

Now, a lengthy ribbon of spring material 150 which is formed with a continuous plurality of return spring leaves 115*a* arranged in series as shown in FIG. 21 is prepared. The return spring 115*a* which is located at one end of the series is provisionally anchored on a keyboard frame 11, and it is cut apart from the adjacent next leaf of return spring 115*a*. In the same way, successive second, third and other return spring leaves 115*a* are provisionally anchored onto the keyboard frame 11 one after another. By so doing, it is possible to perform automatic assembling of the return springs 115*a* onto a plurality of keys one after another.

It should be understood that, at the time of assembling, it is also possible to first mount the key 100 onto the keyboard frame 11, and thereafter to insert the return spring 115 into the spring hole 130 for mounting. In such instance, the spring-anchoring strip 140 is not used, but the one end 115A of the return spring 115 is anchored directly by the spring-anchoring portion 124. It should be noted, however, that, after the key 100 and the return spring 115 have been assembled, one may be intend to remove the key 100, and in such case the one end 115A of the return spring 115 is detached off the spring-anchoring portion 124, and it is provisionally anchored by the spring anchoring strip 140. Accordingly, in case it is intended to mount the key 100 next time, such mounting can be performed in the procedure stated above, and the one end 115A of the return spring 115 is received by the spring-anchoring portion 124 from the spring-anchoring strip 140, and is anchored thereby.

Figure 22:
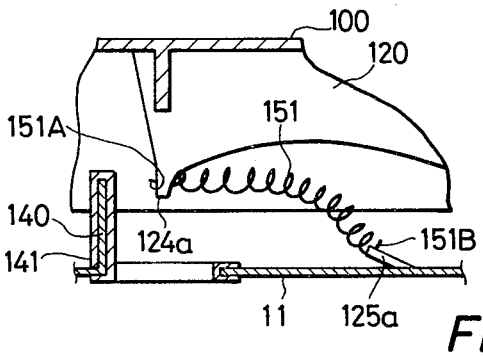
FIG. 22 is a diagrammatic sectional view of an essential part of the keyboard apparatus to show another embodiment of the present invention.

FIG. 22 is a sectional view of an essential part, showing another embodiment of the present invention. In this embodiment, the return spring is constructed with a compression coil spring 31. The other arrangement is substantially the same as that of those embodiments shown in FIGS. 13 to 20. Therefore, their description is omitted. In this embodiment, the one end 151A of the compression coil spring 151 is formed to be a straight wire portion, and is positioned at a substantially central line of the compression coil 151, and the other end 150B is formed in a coil form, and the compression coil spring 151 is spanned in compressed buckled state between a spring-anchoring portion 124*a* and the spring-anchoring portion 125*a* which is comprised of a projection and which is provided on the keyboard frame 11.

In such arrangement as stated above also, the one end 151A of the compression spring 151 is anchored by the rear face of the spring-anchoring strip 140, and the other end 151B is anchored by the spring-anchoring portion 124*a*. Therefore, it will be apparent that, in the same way as for the preceding embodiment, the key 100 can be assembled easily, and that there does not occur a coming-off the compression coil spring 151 or a mishap that the spring is compressed more than necessary, causing a change in the reaction force. Also, due to the relationship between the pivot fulcrum 0 of the key 100 and the pivot fulcrum 125*a* of the compression coil spring 151, the amount of compression of the spring 151 is very small, so that it becomes possible to make the key touch light as in the preceding embodiment.

Figure 16:
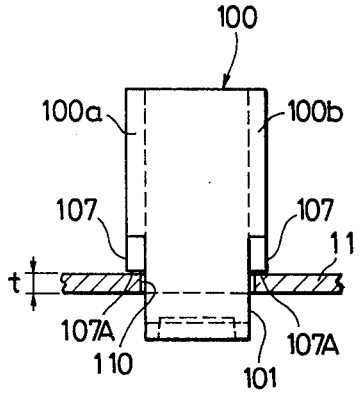
Figure 23:
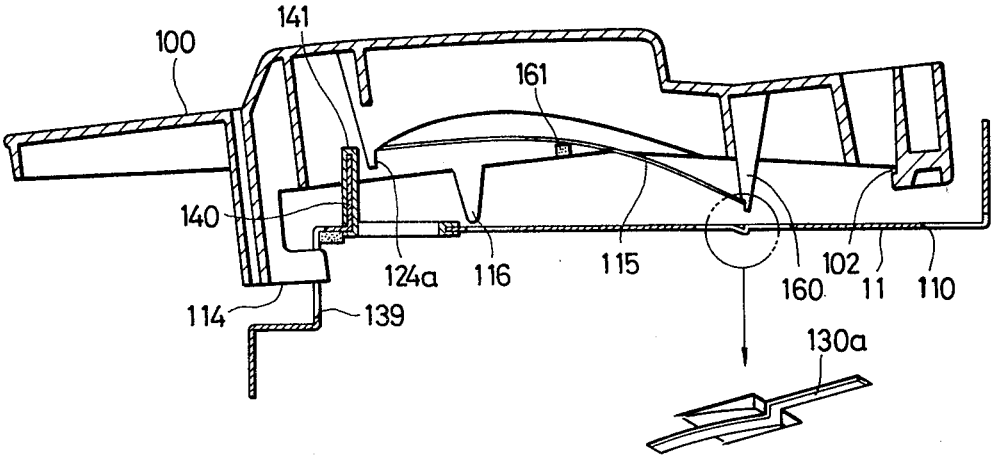
Figure 24:
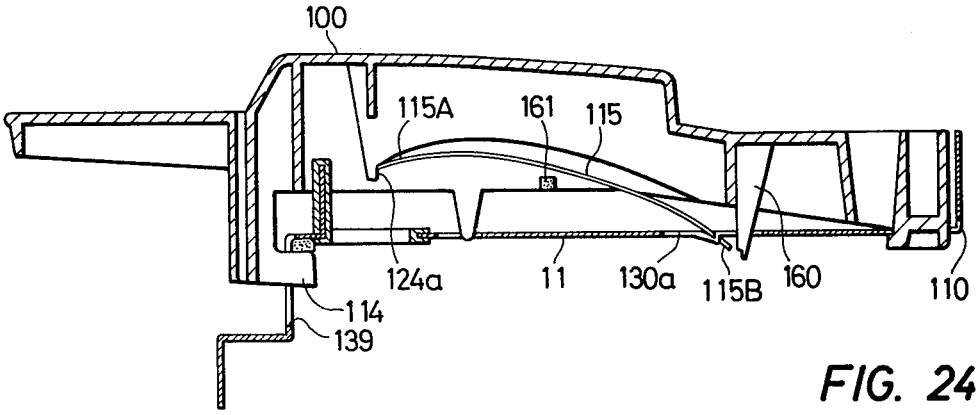
Figure 25:
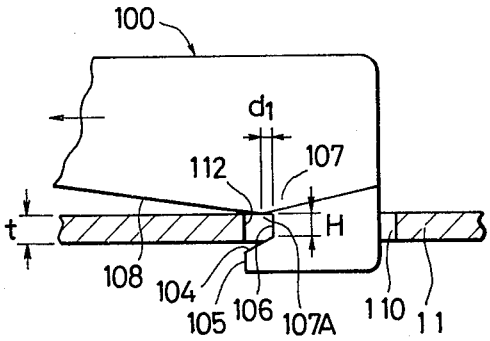
FIG. 25 is an illustration showing a modification representing the engaging recess of FIG. 17 with a different height of its bottom surface.

FIG. 23 is a sectional view of another embodiment of the present invention. In this embodiment, the key 100 is provided with a spring-anchoring strip 160, and a return spring 115 is provisionally anchored by a spring-anchoring portion 124*a* and the spring-anchoring strip 160 of the key 100. In this instance, the return spring 115 is already slightly buckled and deformed, and when the key 100 is mounted on the keyboard frame 11, the one end 115B of the spring 115 which is anchored by the spring-anchoring strip 160 is received and supported by a spring-receiving hole 130*a* of the keyboard frame 11, and thus it can undergo a compression deformation to a sufficient amount. It should be noted here that the spring-anchoring strip 140 of the keyboard frame 11 plays the role of a mere key guide. Also, as shown in FIG. 16, a spring receptacle 161 is provided between the lower ends of the opposing side walls 100*a* and 100*b*, and thereby the return spring 115 may be subjected, at the time of assembling the key, to a buckling to such an extent as is close to causing a buckling deformation. In such instance, the return spring 115 can be prevented from coming off by the spring receptacle 161, and also the key 100 can be mounted easily.

Now, going back again to FIGS. 13 to 20, the present invention will be described further.

According to the keyboard apparatuses having the constructions shown in these Figures, the key 100 can be stably and unfailingly supported, and satisfactory key depressions can be realized. More specifically, in case the keyboard frame 11 is prepared by a punch-through processing from its rear side to form the insertion aperture 110 as shown in FIG. 17, letting the flashes 11*a* resulting from the punching appear on the front side of the frame 11, the region of the material which is scraped by the flashes 11*a* will be only a portion of the bottom surfaces 106 of the engaging recess 102. However, the ridge line 107A of the V-shape receiving portion 107 which restricts the downward movement of the key 100 is positioned at the lateral sides of the engaging recess 102 and is in contact with the surface of the peripheral edges of the insertion aperture 110, and accordingly the ridge line 107A is never scraped off by flashes 11*a*, although, in fact, the inside end of the ridge line portion 107A which contacts the end edge of the insertion aperture 110 will be only slightly scraped, but such scraping can be disregarded because said portion has a length equal to the thickness of the side walls 100*a* and 100*b*, and thus the height h of the surface of the lower portion 106 of the engaging recess 102 can be maintained at a constant value. This can be so realized because the presence of flashes 11*a* can be practically disregarded owing to the fact that the pivot fulcrum portion is constructed by the V-shape receiving portions 107 which are provided on both end portions of the engaging recess 102. Accordingly, occurrence of a play of the key during its operation and the generation of noises can be avoided. A part of the bottom surface 106 and of the ridge line portion 107A is scraped off by flashes 11*a*. It should be understood, however, that after a certain amount of the material of these regions has been scraped off, no further portion of these regions will be scraped off. Also, the scraped-off portion does not constitute the pivot fulcrum of the key 100, so that such region never adversely affects the key-depressing operation. As a result, the service life of the pivot fulcrum portion of the key 100 drastically improves, making any flash-removing operation or a tape-attaching operation unnecessary. Also, because the engaging recess portion 102 can be formed without the use of a slide core, it makes the manufacture of a metal die and maintenance services easy, and thus the apparatus of the present invention can be manufactured at a low cost. In addition, the projection strip portion 105 of the projection and the V-shape receiving portion 107 jointly serve to prevent the sideways tilting of the key 100 during its depression.

As the means of more positively preventing the sideways tilting of the key 100, it is only necessary to set the height H of the surface of the lower end portion 106 (meaning the dimension from the base portion of the inclined surface 104 up to the ridge line portion 107, these two portions constituting the pivot fulcrum) somewhat smaller than the thickness of the plates of the keyboard frame 11 ($H<t$), and also necessary to displace the ridge line 107A toward the front side by an amount $d_1$ from the bottom surface 106. In such instance, there will arise the phenomenon that the engaging recess portion 102 bites in the forward end edge 112 of the insertion aperture 110, causing a slight friction to develop owing to the slide effect which arises between it and the keyboard frame 11. However, vertical as well as lateral play of the key 100 during depression can be completely prevented.

On the other hand, in case the height H of the bottom surface 106 is set a little greater than the thickness t of the plates of the frame ($H>t$), the force of the engaging recess 102 to bite into the insertion aperture 110 will be very small, and accordingly, there hardly will develop a friction due to the slide effect between it and the keyboard frame 11. Thus, it becomes possible to obtain a clear fulcrum construction. In this case, however, there will arise a slight sacrifice which is represented by lateral tilting of the key 100.

It should be understood here that, even when the height H of the lower end surface is changed, the portion which is scraped off by flashes 11*a* does not constitute a region which would in any way hamper the desired function of the pivot fulcrum, and accordingly, the durability of the pivot fulcrum portion is never affected.

Figure 26:
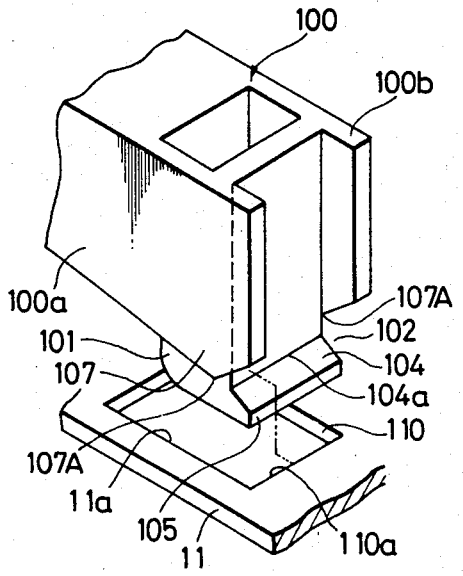
FIG. 26 is a diagrammatic perspective view of an essential part to show another embodiment of the present invention.

FIG. 26 is a perspective view of the essential part of another embodiment of the present invention. The arrangement of this embodiment is identical with the preceding embodiment excepting that an engaging recess 102 is provided on the bottom end of the rear side of the projection 101 and that this engaging recess 102 is caused to engage the rear end edge 110*a* of the insertion aperture 110 by the force of a return spring not shown. In this case, the return spring requires to urge the key 100 rearwardly, so that there is adopted such spring attachment structure as shown in FIG. 10.

In such construction as mentioned above, it will be understood that, by causing flashes 11*a* to appear, as indicated by thick lines, on the surface side of the peripheral edge portion of the insertion aperture 110, the pivot fulcrum of the key 100, i.e. the base portion 104*a* of the side wall portion 104 and the ridge line portion 107A will never be scraped off, and that, thus, there can be obtained an effect similar to that of the preceding embodiment.

Figure 27:
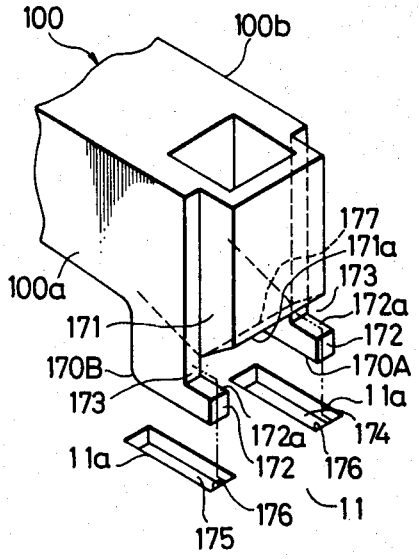
FIG. 27 is a diagrammatic perspective view of an essential part to show another embodiment of the present invention.

FIG. 27 is a perspective view of an essential part, showing another embodiment of the present invention. This embodiment is so constructed that a pair of protrusions 170A and 170B are provided in side-by-side relation on the bottom surface of the rear end portion of the respective side plates 100*a* and 100*b*, respectively, and that a substantially V-shaped receiving portion 171 is provided between the pair of protrusions 170A and 170B. In this case, these protrusions 170A and 170B of the pair are each formed in a substantially L-shape, so that each has a protrusion 172 formed integrally, and the upper surface 172*a* of this protrusion 172 and a rearward inclined surface 171*a* of the V-shaped receiving portion 171*a* jointly constitute a side wall portion of an engaging recess 173.

On the other hand, in the surface of the keyboard frame 11, there are formed a pair of left and right elongated through-holes 174 and 175 at positions corresponding to the pair of protrusions 170A and 170B. The engaging recess portions 173 and 173 will engage the rear end edges 176 and 176 of these elongated through-holes 174 and 175, respectively. In accordace with their engagement, the ridge line portions 177 and 177 of the V-shaped receiving portions 171 and 171 are brought into contact with the rectilinear line, on the surface of the keyboard frame 11, connecting together the rear end edges 176 and 176 of the elongated through-holes 174 and 175, respectively. It should be understood here that the respective elongated through-holes 174 and 175 are formed to have flashes 11*a* on the surface side of the keyboard frame 11.

In such construction as described above, the key 100 has a sufficiently lengthy ridge line 177 as compared with the embodiments of FIGS. 15 and 26. Accordingly, there are the advantages that it is possible to further reduce the effect of flashes 11*a*, and that the service life of the pivot fulcrum portion can be improved.

Figure 28:
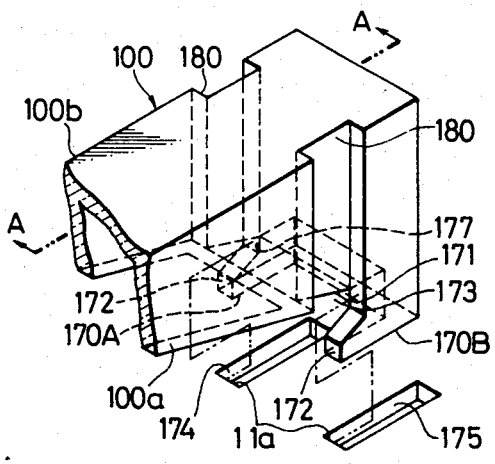
FIG. 28 is a diagrammatic perspective view of an essential part to show another embodiment of the present invention.
Figure 29:
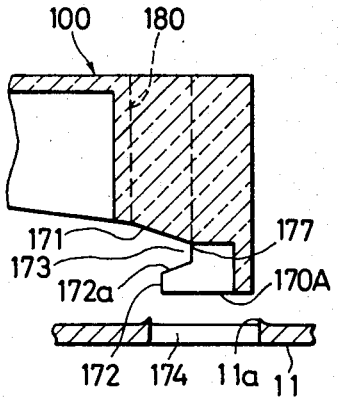
FIG. 29 is a sectional view taken along the line A—A in FIG. 28.

FIG. 28 is a perspective view of an essential part of another embodiment of the present invention, and FIG. 29 is a sectional view taken along the line A—A of FIG. 28. This instant embodiment is a modification of the embodiment shown in FIG. 27. In this embodiment, the protruding strips 172 and 172 of the protrusions 170A and 170B are provided so as to protrude forwardly. In this case, the respective side panels 100*a* and 100*b* are provided vertically with grooves 180 and 180 for forming engaging recesses 173 and 173, respectively, to prevent the interference with the metal die at the time of removal from the die.

Figure 30:
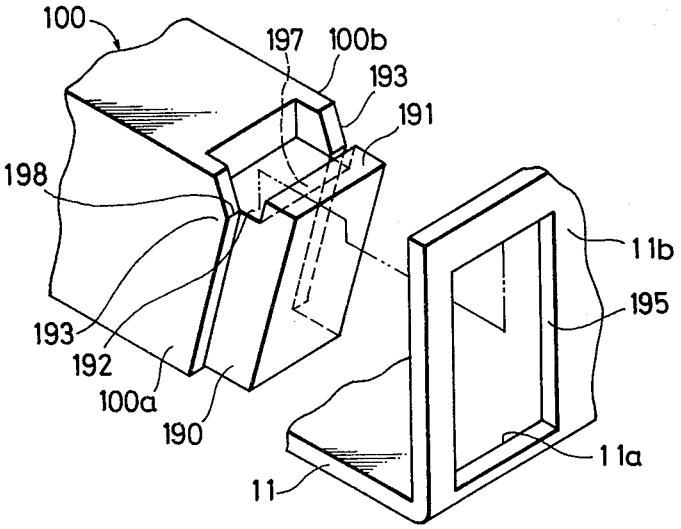
FIG. 30 is a diagrammatic perspective view of an essential part to show another embodiment of the present invention.
Figure 31:
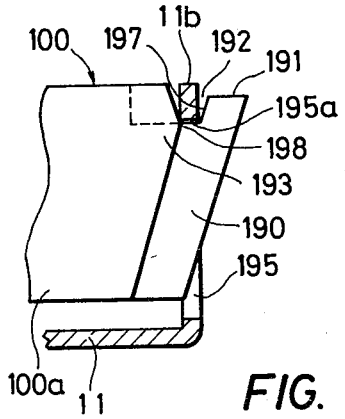
FIG. 31 is a sectional elevation of FIG. 30.

FIG. 30 is a perspective view of an essential part of another embodiment of the present invention, and FIG. 31 is its sectional view. This embodiment is so constructed that a projecting strip 191 is integrally formed on the upper surface of a protrusion 190 extending from the rear end surface of the key 100 to provide an engaging recess 192. In this case, the protrusion 190 is formed to have a width corresponding to the distance between the opposing inner side surfaces of the two side walls 100*a* and 100*b*, and the rear end surfaces of these side walls 100*a* and 100*b* are formed into a substantially>-shape, to thereby constitute a V-shaped receiving portion 193. And, the protrusion 190 is inserted through an insertion aperture 195 of a fulcrum-carrying plate 11*b* which is provided integrally at the rear end of the keyboard frame 11, and the engaging recess 192 is caused to engage an upper end edge 195*a* of the insertion hole 195 by an appropriate means such as by the force of a return spring not shown. As a result, the side wall portions of the engaging recess 192, i.e. the inclined front surface 197 of the projecting strip 191, is positioned on the rear side of the fulcrum plate 11*b* to thereby prevent a casual escape of the key 100, and the ridge line portion 198 of the V-shaped receiving portion 193 contacts the front side of the fulcrum plate 11*b*.

In such arrangement as stated above also, it will be apparent that only the pivot fulcrum portion has moved to the upper surface side of the key 100, and that an effect similar to that obtained from the preceding embodiments such as FIG. 15 can be acquired.

It is added here that, although not illustrated, let us take up the embodiments shown in, for example, FIGS. 5 and 13, and after assembling all the keys onto the keyboard frame, there is inserted a flat elongated plate having an appropriate thickness between the rising portion at the rear end of the keyboard frame and the rear end surfaces of keys. By doing so, it can be possible to prevent the undue coming-off of keys from the keyboard due to a mischievous meddling of keys.

What is claimed is:

1. A keyboard apparatus for an electronic musical instrument, comprising:

keys arranged on a keyboard frame for vertical pivotal movement, and a return spring for each of said keys for normally imparting to the key a returning habit, having one end anchored at a spring-anchoring portion provided on said key and having the other end anchored at a spring-anchoring portion provided on said keyboard frame, and wherein:

said return spring is elastically mounted between said keyboard frame and said key in a buckling-deformed state by its being compressed longitudinally between said spring-anchoring portions.

2. A keyboard apparatus according to claim 1, in which:

said spring-anchoring portion of said keyboard frame is provided between a pivot fulcrum portion of the key and the spring-anchoring portion of the key.

3. A keyboard apparatus according to claim 2, in which:

the spring-anchoring portion of the keyboard frame and the spring-anchoring portion of the key for said return spring are both provided on that said of the key where the key is depressed rather than on the pivot fulcrum portion of the key.

4. A keyboard apparatus according to claim 2, in which:

the spring-anchoring portion of the keyboard frame and the spring-anchoring portion of the key for said return spring are both provided on that side of the key opposite to the side where the key is depressed with respect to the pivot fulcrum of the key.

5. A keyboard apparatus according to claim 1, in which:

said return spring is comprised of a leaf spring.

6. A keyboard apparatus according to claim 1, in which:

said return spring is comprised of a rod-like spring.

7. A keyboard apparatus according to claim 1, in which:

said return spring is comprised of a coil spring.

8. A keyboard apparatus according to claim 1, in which:

said keyboard frame has an opening, each of said keys has an engaging recess adapted to engage an edge of said opening of the keyboard frame to constitute a pivot fulcrum of the key, said return spring provides to the key a force to return to its initial position from a depressed position and concurrently also a force to hold its engagement, by said engaging recess, with said edge of the opening of the keyboard frame.

9. A keyboard apparatus according to claim 1, in which:

the spring-anchoring portion of the keyboard frame is positioned substantially just below the spring-anchoring portion of each key, and the return spring is substantially vertically disposed.

10. A keyboard apparatus according to claim 1, in which:

the spring-anchoring portion of the key is provided between the spring-anchoring portion of the keyboard frame and the pivot fulcrum portion of the key.

11. A keyboard apparatus according to claim 1, in which:

said keyboard frame has a plurality of spring-anchoring strips for said keys, respectively, said spring-anchoring strips each serves to provisionally anchor one end of the return spring prior to mounting each key onto the keyboard frame, and said spring-anchoring portion of the key receives, at the time the key is mounted onto the keyboard frame, one end of the return spring which is provisionally anchored by the spring-anchoring strip.

12. A keyboard apparatus according to claim 1, in which:

each of said keys has a spring-anchoring strip, said spring-anchoring strip, prior to mounting this key onto the keyboard frame, provisionally anchors one end of the return spring, and said spring-anchoring portion of said keyboard frame, at the time the key is mounted thereonto, receives, for anchoring, one end of the return spring which has been provisionally anchored by said spring-anchoring strip.

13. A keyboard apparatus according to claim 1, in which:

each of said keys has, at its rear end portion, an engagement recess having a side wall portion for constituting a pivot fulcrum of the key by its engagement with an end edge of said opening in the keyboard frame, and a V-shaped receiving portion which is positioned at a site displaced widthwise of the key relative to said engaging recess and which includes an inclined surface for substantially constituting the other side wall portion of said engaging recess and having a ridge line contacting a surface of a peripheral edge portion of said opening to constitute said pivot fulcrum portion in cooperation with said engaging recess, said other side wall portion of said engaging recess being positioned on the rear surface of the peripheral edge portion of said opening to prevent casual escaping of said key.

14. A keyboard apparatus according to claim 13, in which:

the dimension frame the base of said inclined surface up to said ridge line portion is set slightly smaller than the thickness of said keyboard frame, and said ridge line is positioned at a site displaced from the base portion of said inclined surface.

15. A keyboard apparatus according to claim 1 wherein said return spring is in said buckling-deformed state even when said key is not being depressed.

16. A keyboard apparatus according to claim 15 wherein said return spring is fixedly anchored at both of said spring-anchoring portions so that no relative movement occurs between each end of said return spring and its respective spring-anchoring portion even while said key is being depressed.

17. A keyboard apparatus according to claim 1 wherein the distance between said spring-anchoring portions on said key and keyboard frame when said key is not being depressed is less than the length of said return spring when in its non-buckling-deformed state.

18. In a musical instrument keyboard in which each key is pivotally supported on a frame, the improvement for simulating the key touch of a piano comprising, for each key:

a bias spring exhibiting a buckling-deformation characterized by a critical buckling load and therebeyond a region of generally rectilinear change in reaction force as a function of longitudinal displacement of said spring, the respective ends of said spring being attached respectively to said each key and said frame with said spring maintained in a buckling-deformed state of compression, so that the reaction force of said spring remains in said generally rectilinear region both while said key is undepressed and throughout depression of said key.

19. In a musical instrument key structure, an elastic member anchored at its ends to said key and to the support for said key and maintained in its buckling state throughout the range of movement of said key.

20. A key structure according to claim 19 wherein in the non-depressed state of said key said elastic member is compressed in its longitudinal direction and is rendered to its buckling state.

21. A key structure according to claim 19 wherein said elastic member is compressed to receive a load above its critical buckling load.

22. A key structure according to claim 19 wherein both ends of said elastic member are anchored such that no relative movement occurs between each end of said member and its respective anchor to said key and support as said key is depressed.

23. A keyboard structure for a musical instrument in which keys are supported on a frame, comprising, for each key:

a generally rectilinear opening in said frame, the width of said opening being less than the width of said key, said key having an integral projection extending through said opening, said projection having a protruding lip which engages an edge of said opening, the body of said key in the vicinity of said projection having a V-shaped region, the ridge line of which seats on said frame and serves as the pivot fulcrum for said key.

24. A keyboard structure according to claim 23 wherein said projection has a generally rectilinear bottom and said protruding lip seats beneath the front or rear edge of said opening, and wherein said key body has two of said V-shaped regions, one on each sidewall of said body.

25. A keyboard structure according to claim 23 wherein said key has a pair of said integral projections spaced laterally, and wherein said V-shaped region is situated between said projections.

26. A keyboard structure according to claim 23 together with a spring situated between said frame and a portion of said key body so as to urge said key body in a direction maintaining said lip in said edge engaging position and also urging upward return of said key after depression of said key has been completed, said spring being maintained in a buckling-deformed state.

* * * * *